United States Patent [19]

Hubbard, deceased

[11] 4,367,982

[45] Jan. 11, 1983

[54] SAFETY DEVICE FOR ANCHORED MARINE STRUCTURE

[75] Inventor: Jack L. Hubbard, deceased, late of Dallas, Tex., by Bonny J. Hubbard, administrator

[73] Assignee: Mobil Oil Corporation, New York, N.Y.

[21] Appl. No.: 183,917

[22] Filed: Sep. 4, 1980

[51] Int. Cl.[3] ..... E02D 21/00

[52] U.S. Cl. ..... 405/202; 114/199; 405/195

[58] Field of Search ..... 405/202, 195, 203–208, 405/224; 114/199, 200, 218

[56] References Cited

U.S. PATENT DOCUMENTS

| | | | |
|---|---|---|---|
| 336,830 | 2/1886 | Winter | 114/199 X |
| 3,191,201 | 6/1965 | Richardson et al. | 405/202 X |
| 3,557,737 | 1/1971 | Smulders | 114/200 |
| 3,645,032 | 2/1972 | Gilliam | 114/218 X |
| 3,650,236 | 3/1972 | McFarlane | 114/218 |
| 3,670,515 | 6/1972 | Lloyd | 405/202 |
| 3,967,572 | 7/1976 | Lea | 114/200 X |

*Primary Examiner*—Dennis L. Taylor

*Attorney, Agent, or Firm*—Charles A. Huggett; Michael G. Gilman; James F. Powers, Jr.

[57] ABSTRACT

A fail-safe guy line system for marine structures. In the event of cable failure near the water surface, a braking device, such as a cable clamp, can be wedged into a sheave or fairlead to prevent loss of the guy line.

7 Claims, 2 Drawing Figures

15
16
18
10
20
35
12
2
40
30
20
ANCHOR 2
12
30
10
20
1
20

SAFETY DEVICE FOR ANCHORED MARINE STRUCTURE

FIELD OF THE INVENTION

This invention relates to marine structures, such as offshore drilling towers, having guy lines for anchoring the structure to the ocean floor. In particular, it relates to a safety device for preventing complete loss of guy lines on the structure due to destruction of a surface portion of the guy lines.

BACKGROUND OF THE INVENTION

A variety of marine structures are employed in drilling and production of offshore oil wells. Offshore platforms are held in position at a fixed point above the marine bottom by guying the structures so as to be able to withstand natural forces, surface vessels and floating objects. So-called guyed towers are elongated, non-buoyant structures which require stabilizing in order to remain vertical. A typical guyed tower is described in U.S. Pat. No. 3,903,705, wherein a number of guy lines are arranged radially around the periphery of the marine structure near the water surface. Anchor means, such as clump weights, may be used to attach one end of each guy line to the marine floor to provide tension in the guy lines.

Positive buoyancy structures may also require similar tensioned cables to prevent sway or excessive tilting. Various offshore platforms of this type are known, for instance as described in U.S. Pat. No. 4,170,186, which discloses a technique for anchoring a buoyant structure by tension leg means. Often the guy lines are continuous cables which are attached to the platform above water, with a portion at or near the surface being exposed. In some constructions, the cable is guided by a below-surface sheave or fairlead attached to the structure for guiding the guy lines and permitting vertical movement of the lines. The upper end of the guy line is attached to the platform above water, either by fixed means, by winches or other cable adjustment means. The configuration of many offshore platforms provides an area of vulnerability to damage or loss of strength in the guy line between the above water platform and the area near the water surface. Damage or loss of strength could occur from fire on the platform or from vessel impact. If a sufficient number of lines were rendered ineffective, the tower stability could be severely impaired or the entire structure could be lost.

It is an object of the present invention to provide a fail-safe mechanism for retaining a large degree of structural stability sufficient to prevent overturning or loss of the marine structure.

SUMMARY OF THE INVENTION

The present invention provides marine structure for placement in a body of water, such as an offshore drilling platform.

A plurality of guy lines are radially disposed around the structure for maintaining the structure in predetermined position above the marine bottom. Operatively connected to each guy line is a means for anchoring the guy line at spaced locations on the marine bottom. Mounted on the marine structure at radially spaced points are a plurality of underwater guide means operatively connected to receive a guy line in sliding relationship. Above water guy line attachment means are disposed to receive the guy lines from corresponding guide means, to fix the lines to the structure. An improvement to this structure includes fixed braking means mounted on each of the guy lines between the guide means and attachment means to prevent loss of the guy lines in the event of a severing of the line above water.

THE DRAWING

DESCRIPTION OF PREFERRED EMBODIMENTS

Figure 1:
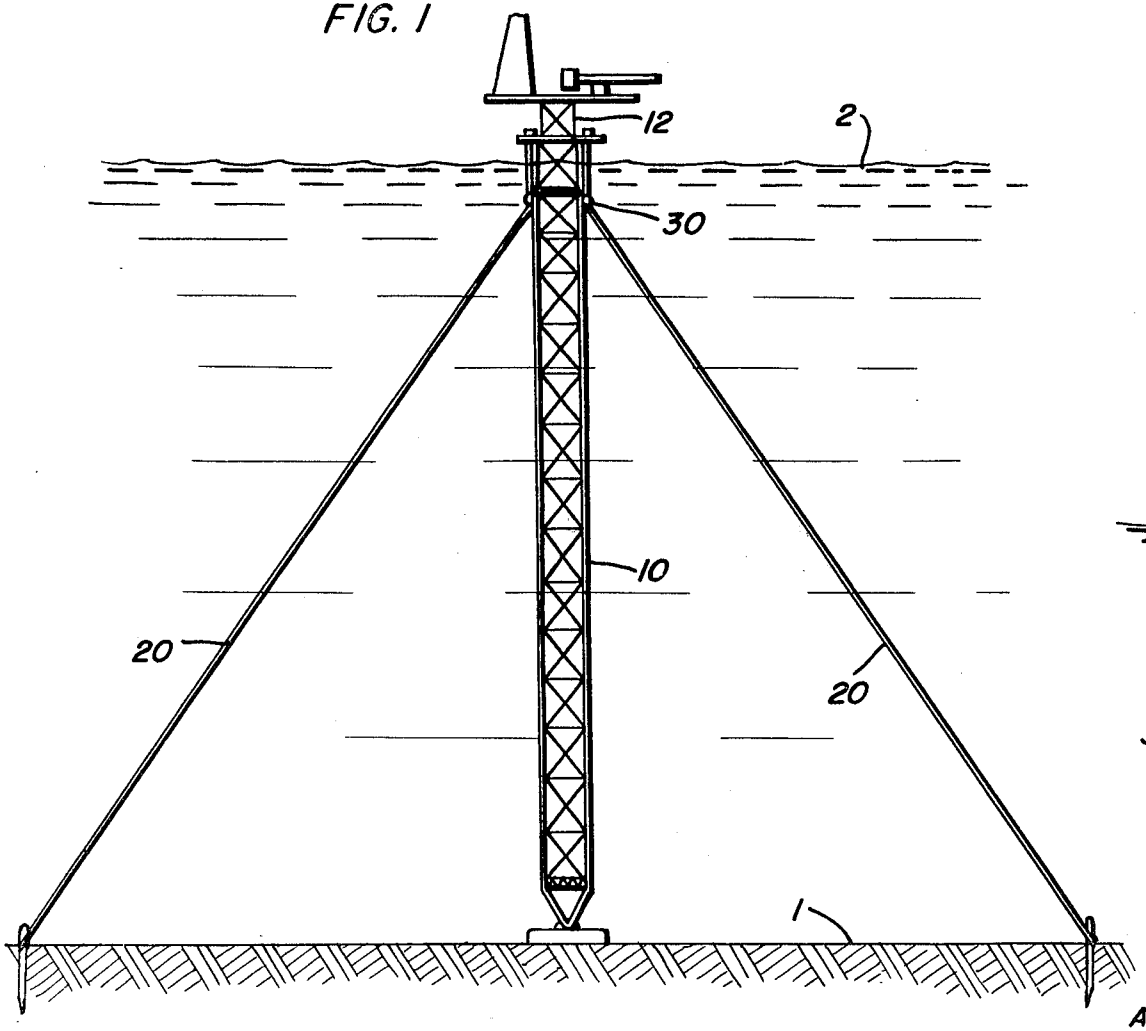
FIG. 1 is an elevational view of a typical guyed marine structure.

Referring to FIG. 1, a marine structure in the form of a guyed tower is shown schematically. A plurality of radially-disposed guy lines 20 are attached between the marine bottom 1 and the upper portion of tower 10 near the surface of water 2. The tower is provided with an above-water platform portion 12. A number of guy lines 20 are passed through guide means 30 attached to tower 10 near the water surface and passed upwardly to a point of attachment at the platform 12.

Figure 2:
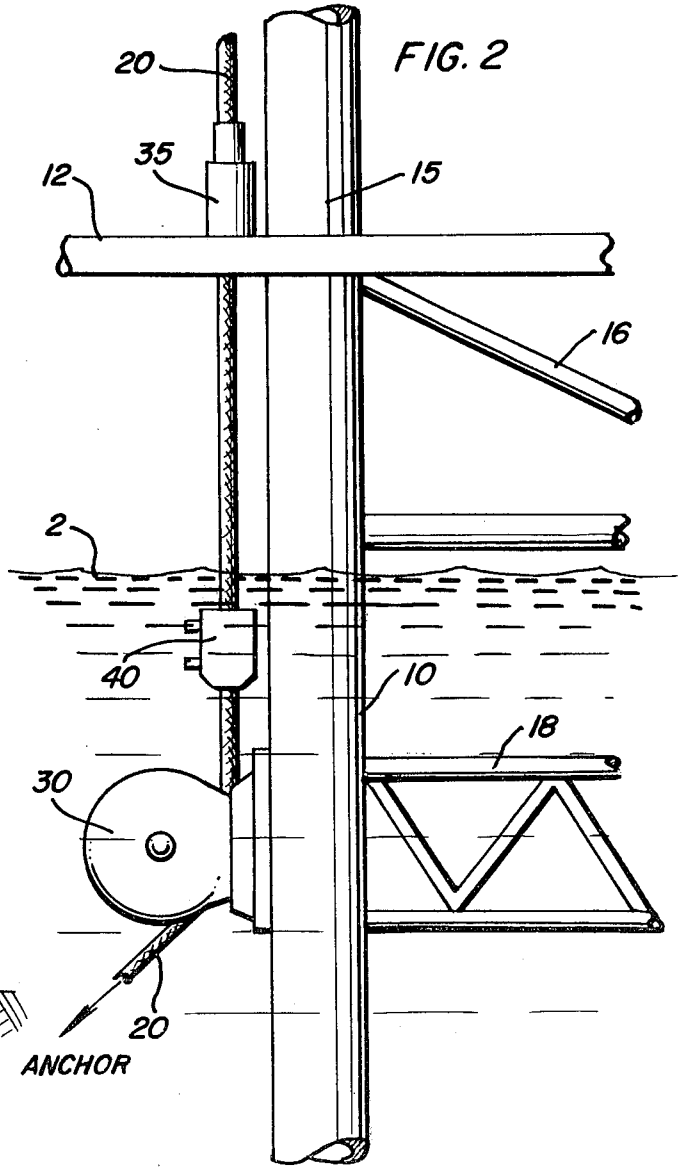
FIG. 2 is a detailed elevation view of a portion of the marine structure showing an improved means for attaching a cable to the structure.

Referring to FIG. 2, a detailed portion of the invention tower 10 is shown partially cut away in vertical elevation view. Structural column member 15 supports a portion of the platform 12 above the water level, and the column is interconnected with other structural members of the tower by cross brace members 16, 18, etc. Guide means, such as sheave 30, is mounted at the periphery of the tower below water level. The guide means has upper and lower connected openings sufficiently large to receive cable 20 therethrough in a vertical position while permitting linear movement. The continuous guy line 20 then passes upwardly exterior to the tower through the platform or flat carrier 12 where it is attached by clamp 35 or other suitable means for holding the guy line 8 in tension against the platform 12. At a point intermediate the sheave 30 and clamp 35, the fail-safe braking device 40 is installed on the guy line 20. The improvement may take the form of a removable clamp, which is attached to the cable 20. After its installation, pressure screws may be employed to attach the clamp 40 to the cable without substantially altering the strength of the cable. The clamps may be located immediately above the sheave or other guide means through which the guy line is threaded. Ordinarily, these clamps will be post-installed by divers in relatively shallow depths to permit a lateral excursion of the tower in extreme environmental conditions without contacting the guide means 30. It is understood that the platform attachment may be a fixed clamp 35 or can employ suitable winch or tackle devices to secure the cable to the tower at a point above water.

Primarily the guide means 30 takes the form of a fixed sheave or a fairlead mounted on the periphery of the marine structure to permit vertical movement of the guy line 20. In the event of severing of the cable at a point near the water surface or adjacent the platform, the submarine safety device functions to retain substantial tethering capability. It is preferred that the clamp 40 have a lower wedge shape, tapering inwardly and downwardly to permit wedging of the clamp into a wedge receiving portion of the guide means 30. To prevent further travel of the guy line the clamp 40 has a lateral dimension larger than the upper opening of guide means 30, thereby holding the safety device during failure of the cable above water. Thus, a satisfactory holding force is established which will prevent the tower from collapsing until repairs and/or replacement of the guy lines can be accomplished.

The safety device may be embodied in a removable clamp having hydraulic actuation for providing release force. For instance, a spring-loaded clamping structure may be lowered into a submarine position on the vertical cable above the guide means and attached to the cable. The holding force of the spring can be overcome by applying opposing hydraulic pressure to a piston-operated clamp opener device attachable to the safety device 40. The clamp may be attached by cementing if a more permanent installation is desired. The safety device advantageously comprises annular collar means having compression means for fitting onto a round cable. Direct contact with a metal cable surface or a sheathed surface is contemplated.

While the invention has been shown and described by certain embodiments, there is no intent to limit the inventive concept except as set forth in the following claims.

I claim:

1. A marine structure for placement in a body of water comprising a plurality of guy lines radially disposed around the structure for maintaining the structure in predetermined position above the marine bottom;

means for anchoring the guy lines at spaced locations on the marine bottom;

a plurality of underwater guide means operatively connected to receive a guy line in sliding relationship, said guide means being mounted on the marine structure at radially spaced points;

a plurality of above water guy line attachment means disposed to receive the guy lines from corresponding guide means; and fixed braking means mounted on each of the guy lines between the guide means and attachment means for contacting its respective guide means to prevent loss of the guy lines in the event of a severing of the line above water, each of said braking means being located above its respective guide means a sufficient distance to permit lateral excursion of said marine structure in extreme environmental conditions without contacting its respective guide means.

2. The structure of claim 1 wherein the guy lines comprise continuous metal cables extending from the anchoring means to the structure above water, wherein the guide means comprises a vertically mounted wedge receiving device having upper and lower connected openings sufficiently large to receive a cable; and wherein the braking means comprises a submarine wedging cable clamp having a lateral dimension larger than said upper opening, whereby the clamp is held by the receiving device during failure of the cable above water.

3. The structure of claim 1 which comprises an offshore drilling tower.

4. The structure of claim 1 wherein the guy lines and the guide means are disposed around the periphery of the structure.

5. The structure of claim 1 wherein the guide means is a sheave.

6. The structure of claim 1 wherein the guide means is a fairlead.

7. The structure of claim 1 wherein the braking means is mounted below water.

* * * * *